US006895916B2

(12) United States Patent
Kaneko et al.

(10) Patent No.: US 6,895,916 B2
(45) Date of Patent: May 24, 2005

(54) FUEL INJECTION CONTROLLER OF INTERNAL COMBUSTION ENGINE

(75) Inventors: Tomohiro Kaneko, Susono (JP); Hiroyuki Tominaga, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/483,228

(22) PCT Filed: Jul. 23, 2002

(86) PCT No.: PCT/JP02/07447

§ 371 (c)(1),
(2), (4) Date: Jan. 9, 2004

(87) PCT Pub. No.: WO03/012275

PCT Pub. Date: Feb. 13, 2003

(65) Prior Publication Data

US 2004/0177835 A1 Sep. 16, 2004

(30) Foreign Application Priority Data

Jul. 26, 2001 (JP) ..... 2001-226415

(51) Int. Cl.[7] ..... F02B 17/00; F02M 41/00
(52) U.S. Cl. ..... 123/179.4; 123/458
(58) Field of Search ..... 123/179.4, 506, 123/458, 511, 198 DB; 701/112; 301/10.6

(56) References Cited

U.S. PATENT DOCUMENTS 5,441,026 A * 8/1995 Akimoto ..... 123/198 D
5,884,597 A * 3/1999 Hiraku et al. ..... 123/179.17
5,977,646 A * 11/1999 Lenz et al. ..... 290/40 C
6,021,763 A * 2/2000 Yoshihara et al. ..... 123/516
6,058,912 A * 5/2000 Rembold et al. ..... 123/516
6,408,825 B1 * 6/2002 Enoki et al. ..... 123/467
6,450,147 B2 * 9/2002 Demura et al. ..... 123/458
6,474,294 B2 * 11/2002 Yamazaki et al. ..... 123/295

FOREIGN PATENT DOCUMENTS

| | | |
|---|---|---|
| JP | 5-1854 | 1/1993 |
| JP | 7-103029 | 4/1995 |
| JP | 7-103097 | 4/1995 |
| JP | 10-89178 | 4/1998 |
| JP | A 11-50881 | 2/1999 |
| JP | A 11-247734 | 9/1999 |
| JP | A 11-315730 | 11/1999 |
| JP | A 2000-240494 | 9/2000 |
| JP | A 2000-248983 | 9/2000 |

* cited by examiner

*Primary Examiner*—Thomas Moulis
(74) *Attorney, Agent, or Firm*—Oliff & Berridge, PLC

(57) ABSTRACT

The pressure within the common-rail 3 is reduced when the engine is stopped without an operation of the automatic engine stopping and restarting device for automatically stopping and restarting the engine to improve fuel consumption. A reducing amount of the pressure within the common-rail 3 when the engine is stopped with an operation of the automatic engine stopping and restarting device is made smaller than that when the engine is stopped without an operation of the automatic engine stopping and restarting device.

6 Claims, 5 Drawing Sheets

FUEL INJECTION CONTROLLER OF INTERNAL COMBUSTION ENGINE

TECHNICAL FIELD

The present invention relates to a fuel injection control device for an internal combustion engine.

BACKGROUND ART

A fuel injection control device for an internal combustion engine comprising a common-rail for accumulating pressurized fuel to improve a restartability of an engine, is known. One instance of such a fuel injection control device for an internal combustion engine is disclosed in, for example, Japanese Unexamined Patent Publication No. 10-89178. In the fuel injection control device disclosed in Japanese Unexamined Patent Publication No. 10-89178, a restartability of an engine is improved without making the pressure within the common-rail fall during the engine stopping. In detail, in the fuel injection control device disclosed in Japanese Unexamined Patent Publication No. 10-89178, the pressure within the common-rail is maintained at a predetermined pressure after the engine has stopped.

Thus, as mentioned above, in the fuel injection control device disclosed in Japanese Unexamined Patent Publication No. 10-89178, for example, after the ignition switch has been turned off and the engine has stopped, the pressure within the common-rail is not reduced to zero and is maintained at a predetermined pressure. Accordingly, for example, if the fuel injection control device for an internal combustion engine fails, fuel in the common-rail can leak. Besides, for example, when the predetermined pressure is set relatively high, combustion noise can become large and an amount of emitted HC can become large during engine restarting and, thus, combustion can deteriorate.

In view of the above problems, an object of the present invention is to provide a fuel injection control device, for an internal combustion engine, which can make the pressure within the common-rail, when the engine stops, a proper value. In detail, it is to provide a fuel injection control device for an internal combustion engine, for example, which can prevent fuel leakage from the common-rail after the ignition switch has been turned off, and the engine has stopped, even if the fuel injection control device for an internal combustion engine fails. Besides, it is to provide a fuel injection control device for an internal combustion engine, which can suppress deterioration of combustion caused by a high pressure within the common-rail at the engine restarting.

DISCLOSURE OF THE INVENTION

According to the present invention described in claim 1, there is provided a fuel injection control device for an internal combustion engine comprising a common-rail accumulating pressurized fuel to improve a restartability of the engine, characterized in that it comprises an automatic engine stopping and restarting device for automatically stopping and restarting the engine to improve fuel consumption, the pressure within the common-rail is reduced when the engine is stopped without operating the automatic engine stopping and restarting device, and a reducing amount of the pressure within the common-rail when the engine is stopped by operating the automatic engine stopping and restarting device is made smaller than that when the engine is stopped without operating the automatic engine stopping and restarting device.

According to the present invention described in claim 2, there is provided a fuel injection control device, for an internal combustion engine according to claim 1, characterized in that the pressure within the common-rail when the engine stops is changed over according as the engine is stopped when operating the automatic engine stopping and restarting device or not.

In the fuel injection control device described in claim 1 or 2, the automatic engine stopping and restarting device for automatically stopping and restarting the engine to improve fuel consumption is provided, and the pressure within the common-rail is reduced when the engine is stopped without operating of the automatic engine stopping and restarting device. If the pressure within the common-rail was not reduced when the engine was stopped without operating the automatic engine stopping and restarting device, for example, such that when the ignition switch was turned off, fuel would leak from the common-rail, for example, when the fuel injection control device failed. However, this fuel leakage can be prevented according to the fuel injection control device described in claim 1 or 2. Besides, a falling amount of the pressure within the common-rail when the engine is stopped with operating of the automatic engine stopping and restarting device, is made smaller than that when the engine is stopped without operating of the automatic engine stopping and restarting device. If the pressure within the common-rail was reduced to, for example, zero when the engine was stopped when operating of the automatic engine stopping and restarting device, the engine restartability would deteriorate. However, this deterioration can be prevented according to the fuel injection control device described in claim 1 or 2. Namely, the pressure within the common-rail when the engine stopping is changed over as the engine is stopped with the operation of the automatic engine stopping and restarting device, or without, and thus the pressure within the common-rail during the engine stopping can be made a proper value as the engine is stopped when operating the automatic engine stopping and restarting device, or without. In detail, the engine restartability can be improved when the engine is stopped with operation of the automatic engine stopping and restarting device, and the fuel leakage from the common-rail can be prevented when the engine is stopped without operating of the automatic engine stopping and restarting device.

According to the present invention described in claim 3, there is provided a fuel injection control device for an internal combustion engine comprising a common-rail accumulating pressurized fuel to improve a restartability of the engine, characterized in that, when it is required that the pressure within the common-rail during the engine stopping is not reduced to zero, if the pressure within the common-rail is higher than a target value, the pressure within the common-rail is reduced by a predetermined amount.

According to the present invention described in claim 4, there is provided a fuel injection control device for an internal combustion engine according to claim 3, characterized in that it comprises an automatic engine stopping and restarting device for automatically stopping and restarting the engine to improve fuel consumption, and when it is required that the engine is stopped with operating of the automatic engine stopping and restarting device, if the pressure within the common-rail is higher than the target value, the pressure within the common-rail is reduced by the predetermined amount.

The pressure within the common-rail during the engine stopping is preferably kept at a relative high pressure to improve the engine restartability. For example, when the engine is stopped immediately after high-speed running or the like, the pressure within the common-rail at the engine stopping is high. At this time, if the pressure within the common-rail was not reduced during the engine stopping, the pressure within the common-rail at the engine restarting would be too high. Therefore, combustion noise can become large and an amount of emitted HC can become large. In view of this, in the fuel injection control device for an internal combustion engine described in claim 3 or 4, when it is required that the pressure within the common-rail is not reduced to zero during the engine stopping, if the pressure within the common-rail is higher than the target value, the pressure within the common-rail is reduced by the predetermined amount. In detail, when it is required that the engine is stopped with operating of the automatic engine stopping and restarting device for automatically stopping and restarting the engine, if the pressure within the common-rail is higher than the target value, the pressure within the common-rail is reduced by the predetermined amount. Therefore, it can be prevented that, at the engine restarting, combustion noise becomes large and an amount of emitted HC becomes large with a high-pressure within the common-rail at the engine restarting. Namely, the pressure within the common-rail during the engine stopping is made a proper value and thus combustion deterioration at the engine restarting can be restrained.

According to the present invention described in claim 5, there is provided a fuel injection control device for an internal combustion engine according to claim 3, characterized in that when it is required that the pressure within the common-rail is not reduced to zero, if the pressure within the common-rail is higher than the target value, the pressure within the common-rail is reduced by the predetermined amount after the engine has been stopped.

According to the present invention described in claim 6, there is provided a fuel injection control device for an internal combustion engine according to claim 4, characterized in that, when it is required that the engine is stopped with the operation of the automatic engine stopping and restarting device, if the pressure within the common-rail is higher than the target value, the pressure within the common-rail is reduced by the predetermined amount after the engine has been stopped.

When the pressure within the common-rail is reduced before the engine is stopped, fuel is consumed while the pressure within the common-rail is reduced. In view of this, in the fuel injection control device described in claim 5 or 6, when it is required that the pressure within the common-rail is not reduced to zero during the engine stopping, if the pressure within the common-rail is higher than the target value, the pressure within the common-rail is reduced by the predetermined value after the engine has been stopped. In detail, when the engine is stopped with the operation of the automatic engine stopping and restarting device, if the pressure within the common-rail is higher than the target value, the pressure within the common-rail is reduced by the predetermined amount after the engine has been stopped. Namely, the pressure within the common-rail is reduced after the engine has been stopped. Therefore, it can be prevented that fuel consumption deteriorates with a fall in the pressure within the common-rail, before the engine is stopped.

BEST MODE FOR CARRYING OUT THE INVENTION

Embodiments according to the present invention are explained by using of the attached drawings as follows.

Figure 1:
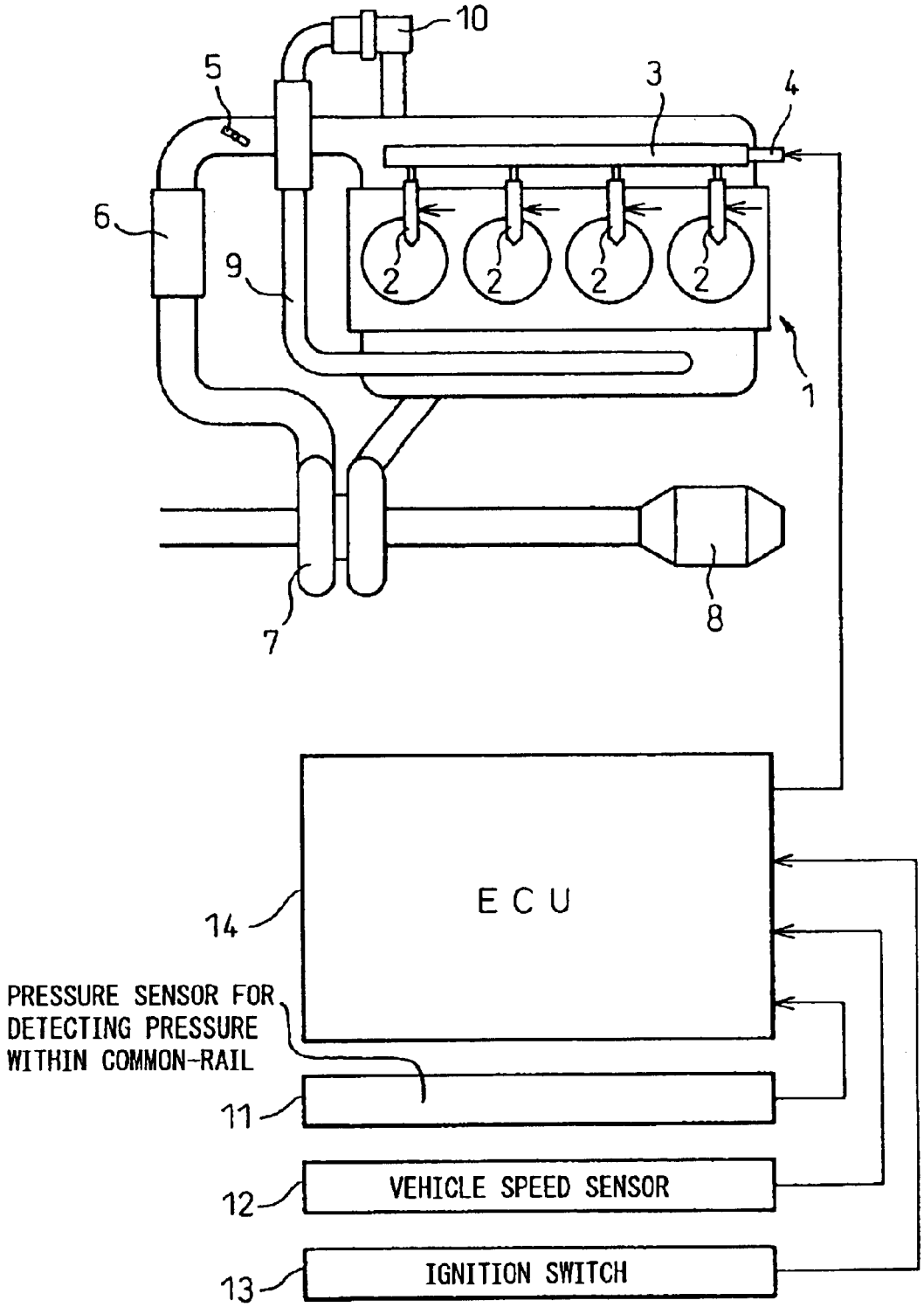
FIG. 1 is a schematic construction view showing a first embodiment of a fuel injection control device for an internal combustion engine according to the present invention.

FIG. 1 is a schematic construction view showing a first embodiment of a fuel injection control device for an internal combustion engine according to the present invention. In FIG. 1, reference numeral 1 is an engine body, 2 is a fuel injector for injecting pressurized fuel, and 3 is a common-rail for accumulating pressurized fuel. Fuel is pressurized by a pump (not shown) to be supplied to the common-rail 3. Reference numeral 4 is a pressure-reducing valve 3 for reducing the pressure within the common-rail 3, 5 is a throttle valve, 6 is a intercooler, 7 is a turbo-charger, 8 is a catalytic system for purifying the exhaust gas, 9 is an EGR passage, and 10 is an EGR control valve. Reference numeral 11 is a pressure sensor for detecting the pressure within the common-rail 3, 12 is a vehicle speed sensor, 13 is an ignition switch, and 14 is an ECU (electronic control unit).

The fuel injection control device for an internal combustion engine of the first embodiment comprises an automatic engine stopping and restarting device for automatically stopping and restarting the engine to improve fuel consumption. For example, when the vehicle is stopped according at a traffic light and the vehicle speed becomes zero without turning off the ignition switch, the automatic engine stopping and restarting device is operated. In detail, the engine is automatically stopped and thereafter the engine is automatically restarted when the driver intends to start the vehicle. On the other hand, for example, when the vehicle is stopped and the vehicle speed becomes zero by turning off the ignition switch, the automatic engine stopping and restarting device is not operated and the engine is stopped according to the requirement of the driver. In this case, the engine is not automatically restarted and the engine is not restarted till the driver operates the starter.

Figure 2:
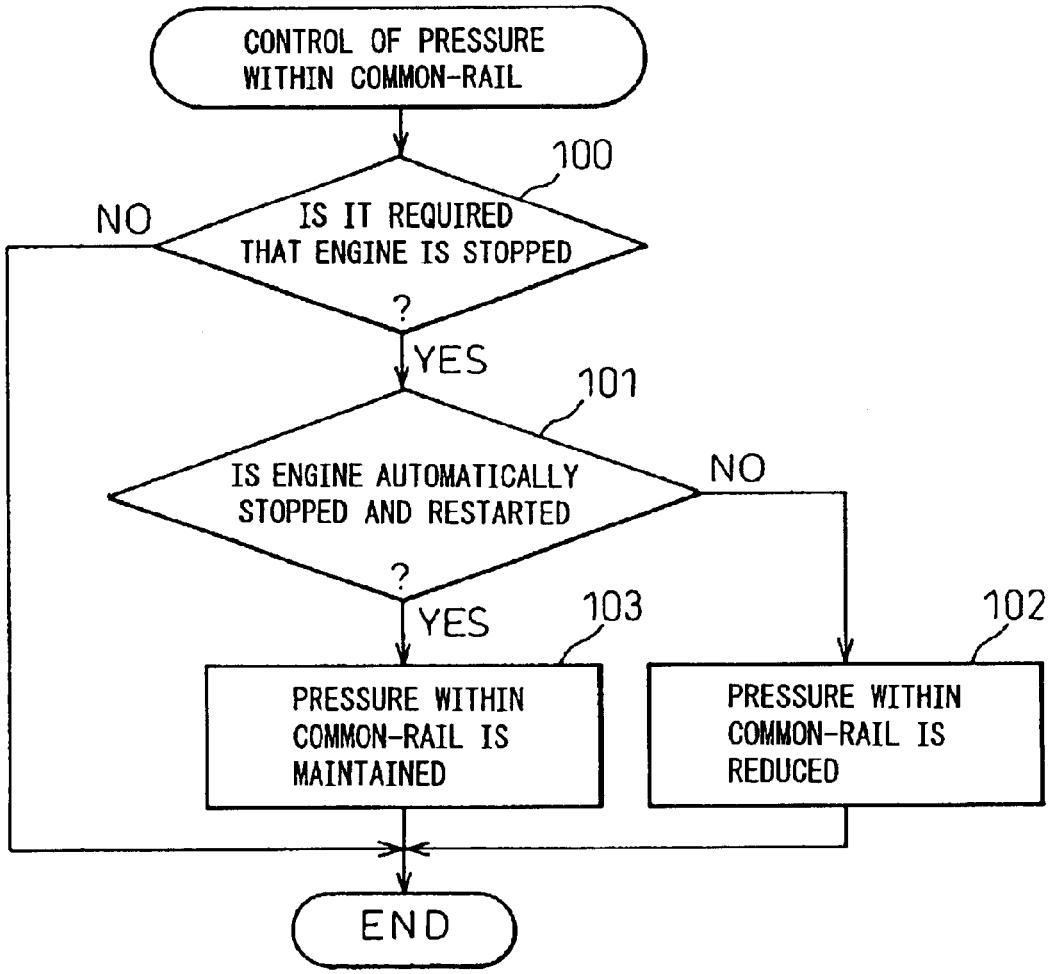
FIG. 2 is a view showing a method for controlling the pressure within the common-rail in the fuel injection control device for an internal combustion engine of the first embodiment, with an automatic engine stopping and restarting device.

FIG. 2 is a view showing a method for controlling the pressure within the common-rail in the fuel injection control device for an internal combustion engine of the first embodiment, with the automatic engine stopping and restarting device. A routine shown in FIG. 2 is carried out every predetermined period. As shown in FIG. 2, immediately after the routine is started, at step 100, it is determined if it is required that the engine is stopped. When it is required that the engine is stopped, the routine goes to step 101. When it is not required that the engine is stopped, the routine is finished. At step 102, it is determined if it is required that the engine is stopped with operating of the above automatic engine stopping and restarting device.

When the engine is stopped without operating of the automatic engine stopping and restarting device, it must be prevented that fuel leaks from the common-rail 3 at a high pressure, for example, in case that the fuel injection control device fails during the engine stopping, and the routine goes to step 102. On the other hand, when the engine is stopped with operating of the automatic engine stopping and restarting device, it must be prevented that the engine restartability deteriorates by reducing the pressure within the common-rail 3, and the routine goes to step 103. At step 102, the pressure-reducing valve 4 is actuated to reduce the pressure within the common-rail 3 such that fuel does not leak from the common-rail 3 even if the fuel injection control device for an internal combustion engine fails during the engine stopping. At step 103, the pressure-reducing valve 4 is not actuated to maintain the pressure within the common-rail 3 such that the engine restartability does not deteriorates with the fall of the pressure within the common-rail 3.

Namely, in the first embodiment, the pressure within the common-rail 3 during the engine stopping is changed over as the engine is stopped with the operation of the automatic engine stopping and restarting device or without. Namely, the pressure within the common-rail 3 is made a proper value as the engine is stopped with the operation of the automatic engine stopping and restarting device or without. Besides, in the first embodiment, at step 103, the pressure-reducing valve 4 is not completely actuated and the pressure within the common-rail 3 is maintained. However, in a modification of the first embodiment, at step 103, the pressure-reducing valve 4 may be actuated such that a reducing amount of the pressure within the common-rail 3 is smaller than that at step 102.

Figure 3A:
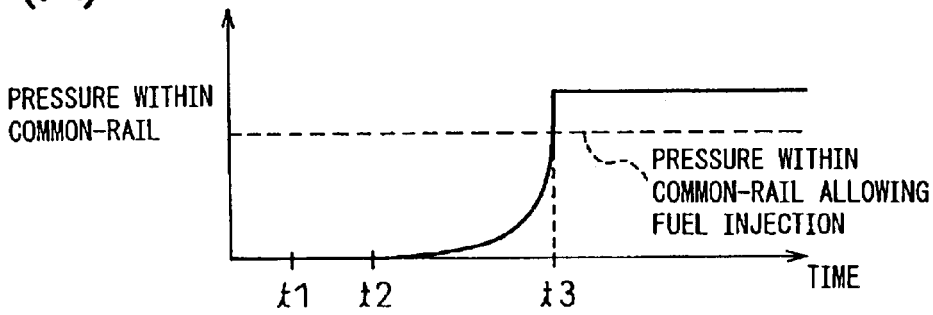
FIG. 3(A) and FIG. 3(B) are views showing a relationship between the pressure within the common-rail and time.
Figure 3B:
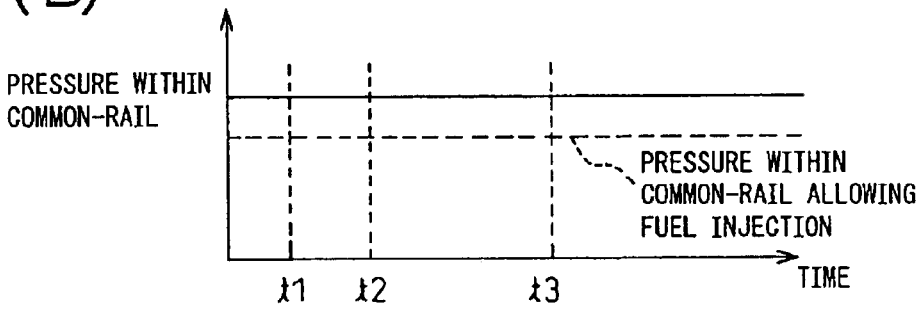

FIG. 3 is views showing a relationship between the pressure within the common-rail and time. In detail, FIG. 3(A) is the view showing the relationship between the pressure within the common-rail and time when step 103 of FIG. 2 is not carried out and thus the pressure within the common-rail is reduced to zero. FIG. 3(B) is the view showing the relationship between the pressure within the common-rail and time when step 103 of FIG. 2 is carried out and thus the pressure within the common-rail during the engine stopping is maintained without reducing. In FIG. 3(A) and FIG. 3(B), the time (t1) shows a time when the requirement, in which fuel should be injected from the fuel injector 2, is issued to restart the engine. The time (t2) shows a time when the cylinder discrimination started at the time (t1) is finished. As shown in FIG. 3(A), when the pressure within the common-rail 3 is reduced to zero during the engine stopping, a period, from when the requirement in which fuel should be injected at the time (t1) is issued, to when the pressure within the common-rail 3 becomes higher than a pressure within the common-rail allowing fuel to be injected, is needed. Fuel is not injected and the engine is not restarted until a time (t3). On the other hand, as shown in FIG. 3(B), when step 103 is carried out and thus the pressure within the common-rail 3 is maintained at a pressure higher than the pressure within the common-rail allowing fuel to be injected, fuel can be injected and the engine can be restarted at the time (t2) when the cylinder discrimination is finished.

According to the first embodiment, the automatic engine stopping and restarting device for automatically stopping and restarting the engine to improve fuel consumption is provided, and the pressure within the common-rail 3 is reduced at step 102 when it is determined at steps 100 and 101 that it is required that the engine is stopped without operating the automatic engine stopping and restarting device. Accordingly, when the engine is stopped without operating the automatic engine stopping and restarting device such that the engine is stopped with turning-off of the ignition switch 13, the pressure within the common-rail 3 is not reduced and thus it can be prevented that fuel leaks from the common-rail 3, for example, when the fuel injection control device fails. Besides, when it is determined at steps 100 and 101 that it is required that engine is stopped by operating the automatic engine stopping and restarting device, the reducing amount of the pressure within the common-rail 3 is made smaller than that when the engine is stopped without operating the automatic engine stopping and restarting device. In detail, the pressure within the common-rail is not reduced but is maintained. Accordingly, it can be prevented the engine restartability deteriorates by reducing, for example, to zero, the pressure within the common-rail when the engine is stopped with operating of the automatic engine stopping and restarting device. Namely, the pressure within the common-rail 3 when the engine stopping is changed over at step 102 or 103 as the engine is stopped with operation of the automatic engine stopping and restarting device or without, and thus the pressure within the common-rail 3 during the engine stopping can be made a proper value as the engine is stopped with operation of the automatic engine stopping and restarting device or without. In detail, by carrying out of step 103, the engine restartability can be improved when the engine is stopped with operating of the automatic engine stopping and restarting device. By carrying out of step 102, it can be prevented that fuel within the common-rail 3 leaks when the engine is stopped without operating of the automatic engine stopping and restarting device.

Figure 4:
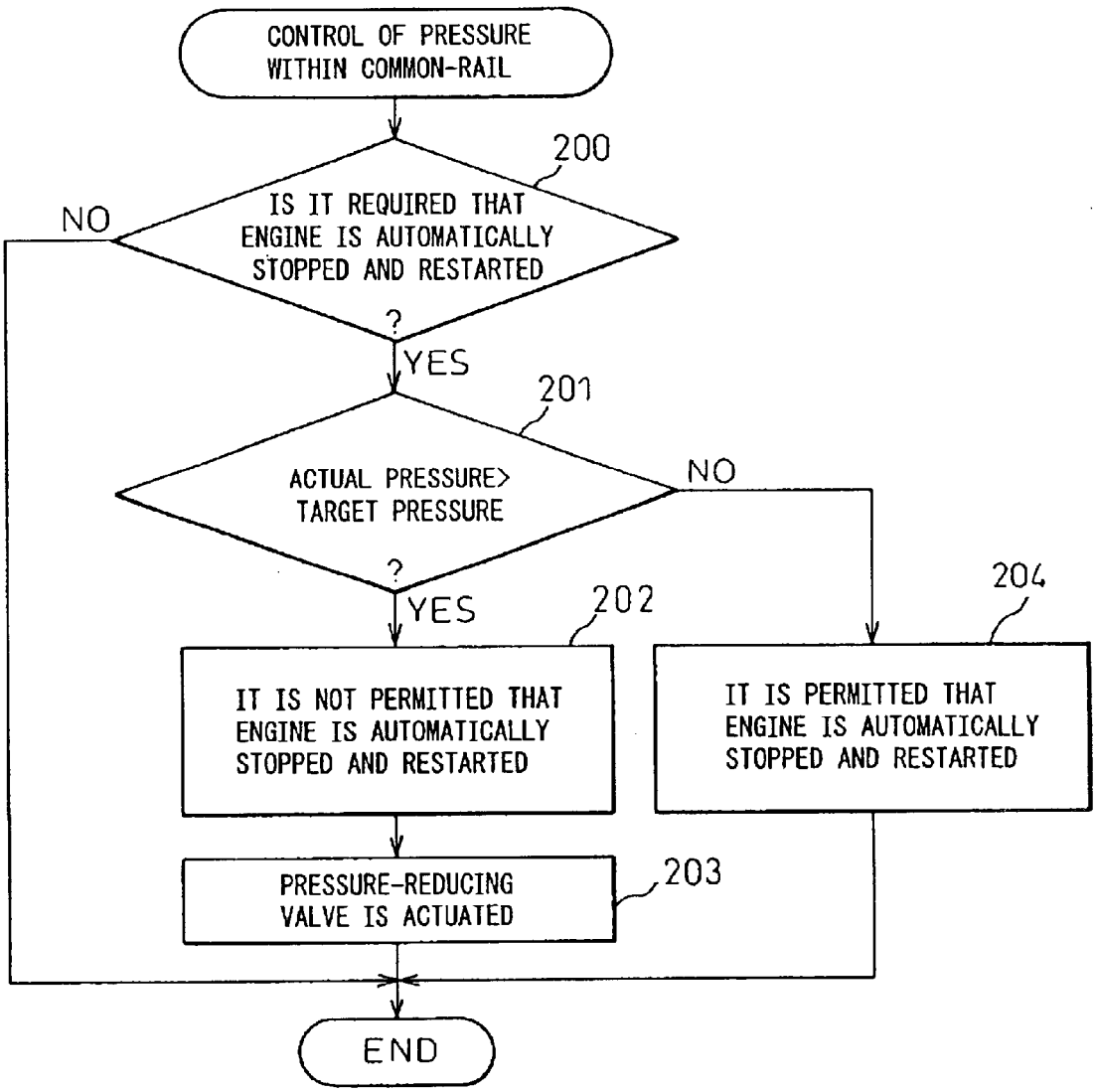
FIG. 4 is a view showing a method for controlling the pressure within the common-rail in the fuel injection control device for an internal combustion engine of a second embodiment, with an automatic engine stopping and restarting device.

Then, a second embodiment of the fuel injection control device for an internal combustion engine according to the present invention is explained. The construction of the second embodiment is substantially the same as the above first embodiment, except as follows. FIG. 4 is a view showing a method for controlling the pressure within the common-rail in the second embodiment of the fuel injection control device for an internal combustion engine with the automatic engine stopping and restarting device. A routine shown in FIG. 4 is carried out every predetermined period. As shown in FIG. 4, immediately after this routine starts, at step 200, it is determined if it is required that the engine is stopped with an operation of the automatic engine stopping and restarting device. Namely, at step 200, it is determined if it is required that the engine is stopped with an operation of the automatic engine stopping and restarting device such that the pressure within the common-rail 3 is not reduced and is maintained. When the result is "YES", the routine goes to step 201. When the result is "NO", the routine is finished.

At step 201, it is determined if an actual pressure within the common-rail detected by the pressure sensor 11 for detecting the pressure within the common-rail is higher than a target pressure within the common-rail. When the actual pressure within the common-rail is higher than the target pressure within the common-rail, it must be prevented that the combustion noise becomes large and the amount of emitted HC becomes large due to the high pressure within the common-rail, and the routine goes to step 202. On the other hand, when the actual pressure within the common-rail is equal to or lower than the target pressure within the common-rail, the combustion noise cannot become large and the amount of emitted HC cannot become large, and the routine goes to step 204. In detail, the engine is automatically stopped with an operation of the automatic engine stopping and restarting device. Then, the pressure within the common-rail 3 is not reduced and maintained during the engine stopping as shown in FIG. 1. Next, when the engine is restarted, the combustion noise cannot become large and the amount of emitted HC cannot become large, and the routine goes to step 204.

At step 202, it is inhibited to operate the automatic engine stopping and restarting device. In detail, it is inhibited that the engine is stopped while the pressure within the common-rail 3 is not reduced and maintained. Next, at step 203, the pressure-reducing valve 4 is actuated and thus the pressure within the common-rail 3 is reduced. When the pressure within the common-rail 3 is reduced and the actual pressure within the common-rail is equal or lower than the target pressure within the common-rail, the result at step 201 in the routine shown in FIG. 4 will become "NO" the next time. Thus, it is allowed that the automatic engine stopping and restarting device is operated at step 204, and the pressure within the common-rail 3 is not reduced and maintained, and the engine is stopped.

Namely, in the second embodiment, the pressure within the common-rail 3 is reduced at step 203 before the engine is stopped with operating of the automatic engine stopping and restarting device. Namely, the pressure within the common-rail 3 is reduced at step 203 before the engine is restarted with an operation of the automatic engine stopping and restarting device.

The pressure within the common-rail 3 during the engine stopping is preferably maintained relative high to improve the engine restartability. However, when the engine was stopped, for example, immediately after an high speed running of the vehicle, and the pressure within the common-rail 3 at the engine stopping was considerably high, if the pressure within the common-rail 3 was not reduced, the combustion noise would become large and the amount of emitted HC would become large because the pressure within the common-rail 3 would be too high at the engine restarting. In view of this, according to the second embodiment, when it is required that the pressure within the common-rail 3 during the engine stopping is not reduced to zero, if the pressure within the common-rail is higher than the target pressure within the common-rail, the pressure within the common-rail is reduced by the predetermined value at step 203. In detail, when it is determined that the engine is stopped with operating of the automatic engine stopping and restarting device at step 200, and it is determined that the actual pressure within the common-rail is higher than the target pressure within the common-rail at step 201, the pressure-reducing valve 4 is actuated at step 203 and the pressure within the common-rail is reduced by the predetermined value. Therefore, it can be prevented that the combustion noise becomes large and the amount of emitted HC becomes large at the engine restarting due to a high pressure within the common-rail at the engine restarting. Namely, the pressure within the common-rail during the engine stopping is made a proper value and thus it can be restrained that the combustion at the engine restarting deteriorates.

In the above second embodiment, the automatic engine stopping and restarting device is provided. However, a modification of the second embodiment can omit the automatic engine stopping and restarting device. In also the modification of the second embodiment, when it is required that the pressure within the common-rail during the engine stopping is not reduced to zero, if the actual pressure within the common-rail is higher than the target pressure within the common-rail, the pressure within the common-rail is reduced by the predetermined amount before the engine is restarted. Accordingly, it can be prevented that the combustion noise becomes large and the amount of emitted HC becomes large at the engine restarting due to the high pressure within the common-rail at the engine restarting.

Figure 5:
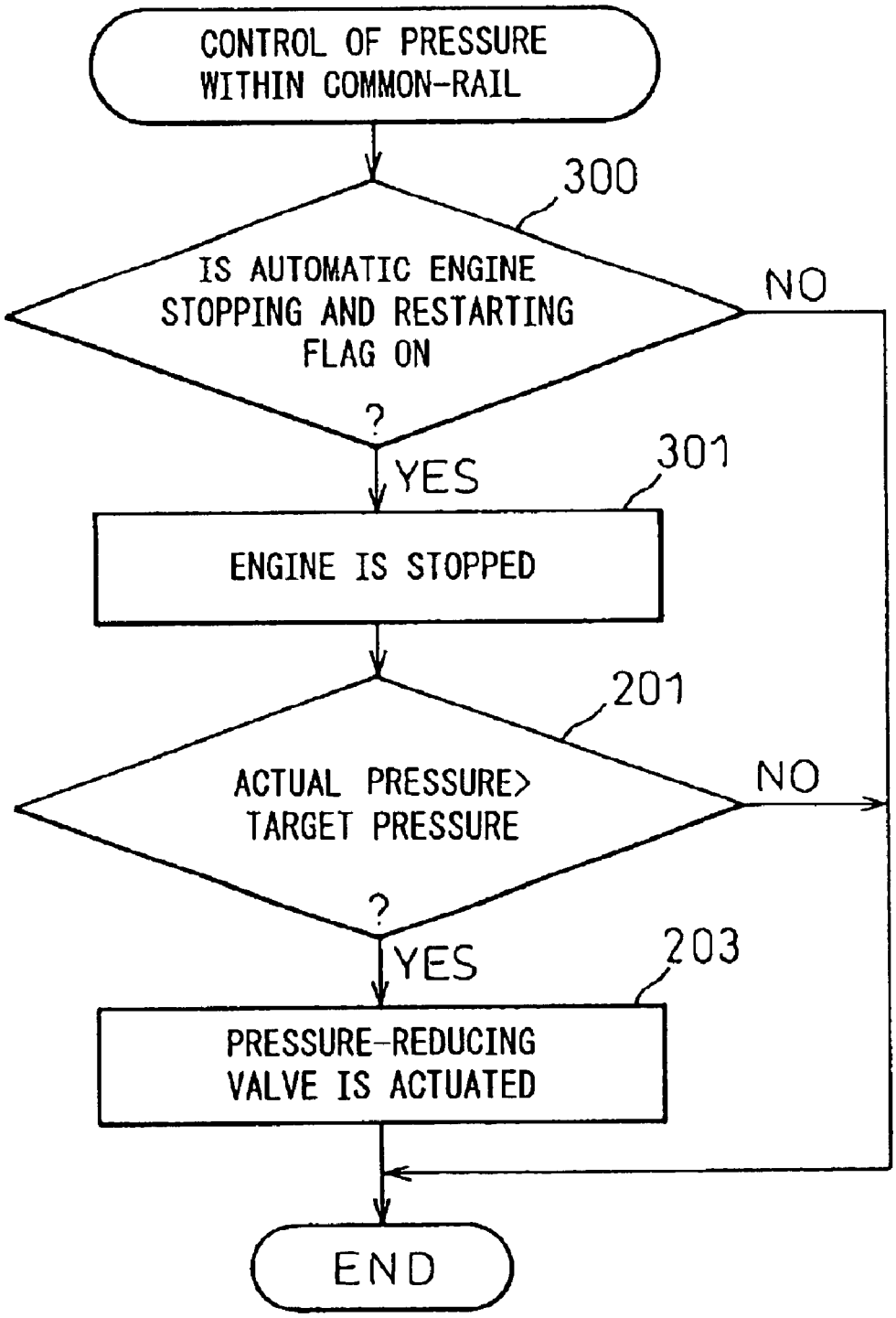
FIG. 5 is a view showing a method for controlling the pressure within the common-rail in the fuel injection control device for an internal combustion engine of a third embodiment, with an automatic engine stopping and restarting device.

Next, a third embodiment of the fuel injection control device for an internal combustion engine according to the present invention will be explained. The construction of the third embodiment is substantially the same as the above first or second embodiment, except follows. FIG. 5 is a view showing a method for controlling the pressure within the common-rail in the third embodiment of the fuel injection control device for an internal combustion engine with the automatic engine stopping and restarting device. A routine shown in FIG. 5 is carried out every predetermined period. As shown in FIG. 5, immediately after this routine starts, at step 300, it is determined if an automatic engine stopping and restarting flag is "ON", which flag permits the engine be stopped with an operation of the automatic engine stopping and restarting device. Namely, at step 300, it is determined if the automatic engine stopping and restarting flag is "ON", which flag permits the engine be stopped with operating of the automatic engine stopping and restarting device such that the pressure within the common-rail 3 is not reduced and maintained. When the result is "YES", the routine goes to step 301. When the result is "NO", the routine is finished.

At step 301, the engine is stopped. In detail, the engine is stopped with operating of the automatic engine stopping and restarting device such that the pressure within the common-rail 3 is not reduced and maintained. Next, at step 201, it is determined if an actual pressure within the common-rail detected by the pressure sensor 11 for detecting the pressure within the common-rail is higher than a target pressure within the common-rail similarly with the second embodiment. When the actual pressure within the common-rail is higher than the target pressure within the common-rail, it must be prevented that the combustion noise becomes large and the amount of emitted HC becomes large due to the high pressure within the common-rail, and the routine goes to step 203. On the other hand, when the actual pressure within the common-rail is equal to, or lower than, the target pressure within the common-rail, the combustion noise cannot become large and the amount of emitted HC cannot become large, and the routine is finished. In detail, at step 301, the engine is stopped with an operation of the automatic engine stopping and restarting device such that the pressure within the common-rail is not reduced and maintained. Then, at a not-shown step, it is determined that the combustion noise cannot become large and the amount of emitted HC cannot become large even if the engine is restarted under the present pressure within the common-rail, and thus the routine is finished.

At step 203, the pressure-reducing valve 4 is actuated similarly to the second embodiment, and the pressure within the common-rail 3 is reduced. When the pressure within the common-rail 3 is reduced and the actual pressure within the common-rail is equal to or lower than the target pressure within the common-rail, at a not-shown step, it is determined that the combustion noise cannot become large and the amount of emitted HC cannot become large even if the engine is restarted under the pressure within the common-rail.

Namely, in the third embodiment, different from the second embodiment, after the engine is stopped with operating of the automatic engine stopping and restarting device at step 301, the pressure within the common-rail 3 is reduced at step 203. Thus, similarly to the second embodiment, before the engine is restarted with operating of the automatic engine stopping and restarting device, the pressure within the common-rail 3 is reduced at step 203.

According to the third embodiment, when it is required that the pressure within the common-rail 3 during the engine stopping is not reduced to zero, if the pressure within the common-rail is higher than the target pressure within the common-rail, the pressure within the common-rail is reduced by the predetermined amount at step 203. In detail, when it is determined at step 300 that it is required that the engine is stopped with an operation of the automatic engine stopping and restarting device and it is determined at step 201 that the actual pressure within the common-rail is higher than the target pressure within the common-rail, the pressure-reducing valve 4 is actuated at step 203 and the pressure within the common-rail is reduced by the predetermined amount. Therefore, it can be prevented that the combustion noise becomes large and the amount of emitted HC becomes large at the engine restarting due to the high pressure within the common-rail at the engine restarting. Namely, the pressure within the common-rail during the engine stopping is made a proper value and thus it can be prevented that the combustion at the engine restarting deteriorates.

If the pressure within the common-rail is reduced by using of the fuel injection before the engine is stopped as the second embodiment, fuel is consumed when reducing the pressure within the common-rail. In view of this, according to the third embodiment, when it is required that the pressure within the common-rail during the engine stopping is not reduced to zero, if the actual pressure within the common-rail is higher than the target pressure within the common-rail, the pressure-reducing valve 4 is actuated at step 203 after the engine is stopped at step 301 and thus the pressure within the common-rail is reduced by the predetermined amount. In detail, when it is determined at step 300 that it is required and permitted that the engine is stopped with operating of the automatic engine stopping and restarting device, and it is determined at step 201 that the actual pressure within the common-rail is higher than the target pressure within the common-rail, the pressure within the common-rail is reduced by the predetermined amount at step 203 after the engine is stopped at step 301. Namely, the pressure within the common-rail is reduced after the engine is stopped. Therefore, it can be prevented that the fuel consumption deteriorates with reducing of the pressure within the common-rail before the engine stopping.

In the above third embodiment, the automatic engine stopping and restarting device is provided. However, a modification of the third embodiment can omit the automatic engine stopping and restarting device. In the modification of the third embodiment, when it is required that the pressure within the common-rail during the engine stopping is not reduced to zero, if the actual pressure within the common-rail is higher than the target pressure within the common-rail, the pressure within the common-rail is reduced by the predetermined amount before the engine is restarted. Accordingly, it can be prevented that the combustion noise becomes large and the amount of emitted HC becomes large at the engine restarting due to the high pressure within the common-rail at the engine restarting. On the other hand, when it is required that the pressure within the common-rail during the engine stopping is not reduced to zero, if the actual pressure within the common-rail is higher than the target pressure within the common-rail, the pressure within the common-rail is reduced by the predetermined amount after the engine is stopped. Accordingly, it can be prevented that the fuel consumption deteriorates with reducing of the pressure within the common-rail before the engine stopping.

According to the present invention described in claim 1 or 2, it can be prevented that the pressure within the common-rail is not reduced when the engine was stopped without operating of the automatic engine stopping and restarting device, for example, such that the ignition switch was turned off, and thus fuel would leak from the common-rail, for example, when the fuel injection control device was troubled. Besides, it can be prevented that the pressure within the common-rail is reduced, for example, to zero when the engine is stopped with operating of the automatic engine stopping and restarting device and thus the engine restartability deteriorates. Namely, the pressure within the common-rail during the engine stopping is changed over according as the engine is stopped with an operation of the automatic engine stopping and restarting device or without, and thus the pressure within the common-rail during the engine stopping can be made a proper value as the engine is stopped with an operation of the automatic engine stopping and restarting device or without.

According to the present invention described in claim 3 or 4, it can be prevented that the combustion noise becomes large and the amount of emitted HC becomes large at the engine restarting due to the high pressure within the common rail at the engine restarting. Namely, the pressure within the common-rail during the engine stopping is made a proper value and thus combustion deterioration at the engine restarting can be restrained.

According to the present invention described in claim 5 or 6, it can be prevented that the fuel consumption deteriorates with a reduction of the pressure within the common-rail before the engine stopping.

What is claimed is:

1. A fuel injection control device for an internal combustion engine comprising a common-rail for accumulating pressurized fuel to improve a restartability of the engine, characterized in that it comprises an automatic engine stopping and restarting device for automatically stopping and restarting the engine to improve fuel consumption, the pressure within the common-rail is reduced when the engine is stopped without operating the automatic engine stopping and restarting device, and a reducing amount of the pressure within the common-rail when the engine is stopped with operating of the automatic engine stopping and restarting device is made smaller than that when the engine is stopped without operating the automatic engine stopping and restarting device.

2. A fuel injection control device for an internal combustion engine according to claim 1, characterized in that the pressure within the common-rail during the engine stopping is changed over as the engine is stopped with an operation of the automatic engine stopping and restarting device, or without.

3. A fuel injection control device for an internal combustion engine according to claim 1, characterized in that the pressure within the common-rail is not reduced and maintained when the engine is stopped with operating the automatic engine stopping and restarting device.

4. A fuel injection control device for an internal combustion engine comprises a common-rail for accumulating pressurized fuel and an automatic engine stopping and restarting device for automatically stopping and restarting the engine, characterized in that when it is required that the engine is stopped with an operation of the automatic engine stopping and restarting device, if the pressure within the common-rail is higher than a target value, the pressure within the common-rail is reduced by a predetermined amount.

5. A fuel injection control device for an internal combustion engine according to claim 4, characterized in that when the pressure within the common-rail is reduced and becomes equal to or lower than the target value, it is permitted that the automatic engine stopping and restarting device is operated and the engine is stopped.

6. A fuel injection control device for an internal combustion engine comprising a common-rail for accumulating pressurized fuel and an automatic engine stopping and restarting device for automatically stopping and restarting the engine, characterized in that when it is required that the engine is stopped with an operation of the automatic engine stopping and restarting device, if the pressure within the common-rail is higher than a target value, the pressure within the common-rail is reduced by a predetermined amount after the engine has been stopped with an operation of the automatic engine stopping and restarting device.

* * * * *